US010836454B2

(12) United States Patent
Walpurgis et al.

(10) Patent No.: US 10,836,454 B2
(45) Date of Patent: Nov. 17, 2020

(54) FLOATING VESSEL

(71) Applicant: Cayago GmbH, Kitzbühel (AT)

(72) Inventors: Hans-Peter Walpurgis, Kitzbühel (AT); Peter Schnauffer, Oberdingen (DE)

(73) Assignee: CAYAGO TEC GmbH (DE)

( * ) Notice: Subject to any disclaimer, the term of this patent is extended or adjusted under 35 U.S.C. 154(b) by 20 days.

(21) Appl. No.: 15/761,121

(22) PCT Filed: Sep. 19, 2016

(86) PCT No.: PCT/EP2016/072204
§ 371 (c)(1),
(2) Date: Sep. 5, 2018

(87) PCT Pub. No.: WO2017/050708
PCT Pub. Date: Mar. 30, 2017

(65) Prior Publication Data

US 2018/0370599 A1 Dec. 27, 2018

(30) Foreign Application Priority Data

Sep. 21, 2015 (DE) ..... 10 2015 115 895

(51) Int. Cl.
*B63H 21/17* (2006.01)
*B63B 1/12* (2006.01)
(Continued)

(52) U.S. Cl.
CPC ..... *B63B 1/125* (2013.01); *B63B 7/00* (2013.01); *B63B 7/085* (2013.01); *B63B 34/10* (2020.02);
(Continued)

(58) Field of Classification Search
CPC ..... B63H 20/007; B63H 2005/1258; B63H 21/17; B63H 21/213; B63H 2021/216; B63B 2001/186
See application file for complete search history.

(56) References Cited

U.S. PATENT DOCUMENTS 5,593,329 A 1/1997 Kato
6,132,267 A * 10/2000 Campbell ..... B63H 5/08 114/347
(Continued)

FOREIGN PATENT DOCUMENTS

CN 202138494 U 2/2012
CN 104260846 A 1/2015
(Continued)

OTHER PUBLICATIONS

Australian Office Action for corresponding patent application No. 2016326860, dated Mar. 4, 2020, 3 pages.
(Continued)

*Primary Examiner* — Andrew Polay
(74) *Attorney, Agent, or Firm* — Lucian Wayne Beavers; Gary L. Montle; Patterson Intellectual Property Law, PC

(57) ABSTRACT

The invention relates to a floating vessel comprising a hull, at least one seat, and two outriggers arranged laterally to the hull and connected directly or indirectly to the hull, wherein a drive unit, separately controllable in its drive output, and comprising a respective at least one propeller driven by a motor, in particular an electric motor, is assigned to each outrigger. A helm of the floating vessel is thereby connected to a proportional transducer, and a control signal from the proportional transducer is supplied to a control unit which directly or indirectly controls the motors in accordance with
(Continued)

Figure 1:
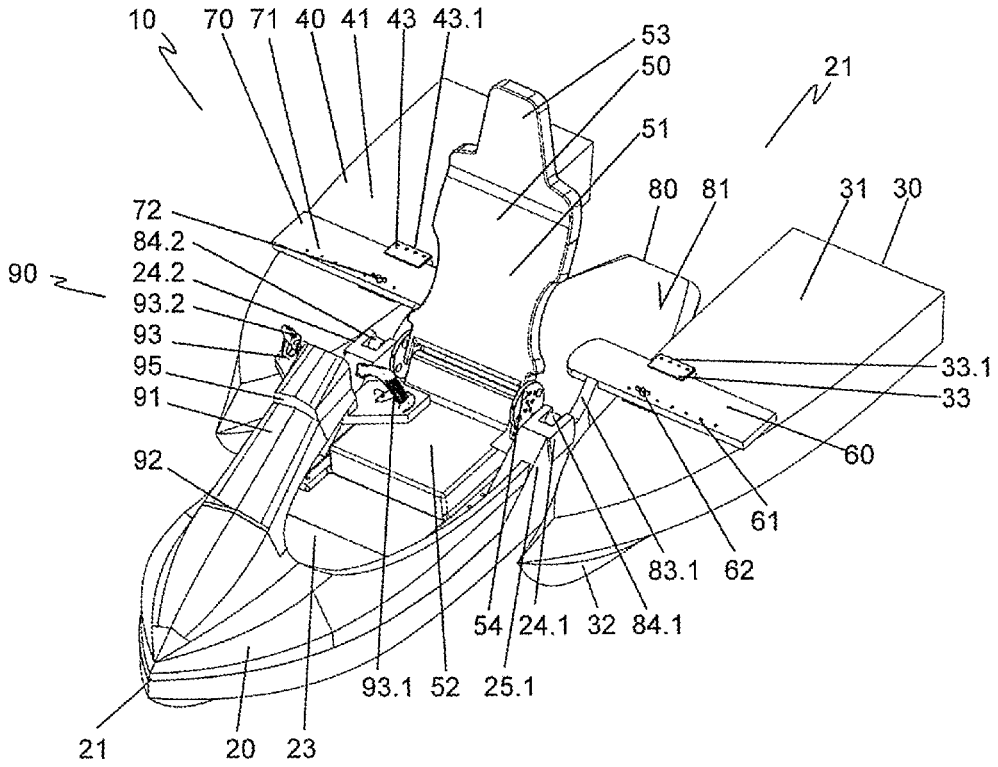

the control signal from the proportional transducer. Thus, a precisely controllable and yet easily disassemblable floating vessel is provided.

20 Claims, 6 Drawing Sheets

(51) Int. Cl.

| | |
|---|---|
| ***B63B 7/00*** | (2020.01) |
| ***B63H 5/07*** | (2006.01) |
| ***B63B 34/10*** | (2020.01) |
| ***B63B 7/08*** | (2020.01) |
| ***B63H 5/08*** | (2006.01) |
| ***B63H 5/14*** | (2006.01) |

(52) U.S. Cl.
CPC ..... *B63H 5/07* (2013.01); *B63H 5/08* (2013.01); *B63H 5/14* (2013.01); *B63H 21/17* (2013.01); *B63B 2007/003* (2013.01)

(56) References Cited

U.S. PATENT DOCUMENTS

| | | | | |
|---|---|---|---|---|
| 7,131,389 | B1 | 11/2006 | Hawkes | |
| 8,584,549 | B2 | 11/2013 | Cheng et al. | |
| 2002/0023579 | A1 | 2/2002 | Profitt et al. | |
| 2002/0090866 | A1* | 7/2002 | Hoshina | B63H 21/213 440/84 |
| 2004/0003767 | A1 | 1/2004 | Adamczyk et al. | |
| 2004/0168623 | A1 | 9/2004 | Kirk | |
| 2010/0009579 | A1* | 1/2010 | Wood | B63B 35/665 440/6 |
| 2010/0191396 | A1 | 7/2010 | Nose et al. | |
| 2011/0166724 | A1 | 7/2011 | Hiramatsu | |
| 2011/0303041 | A1 | 12/2011 | Cheng et al. | |
| 2012/0071044 | A1* | 3/2012 | Rembach | B63H 21/21 440/6 |
| 2015/0166159 | A1 | 6/2015 | Inoue et al. | |
| 2015/0246714 | A1 | 9/2015 | Morikami et al. | |
| 2015/0259033 | A1 | 9/2015 | George et al. | |

FOREIGN PATENT DOCUMENTS

| | | | |
|---|---|---|---|
| DE | 19538563 | A1 | 4/1996 |
| EP | 2585363 | A1 | 5/2013 |
| FR | 2437343 | A1 | 4/1980 |
| GB | 2467364 | A | 8/2010 |
| JP | 69009885 | A | 1/1994 |
| KR | 1020050012293 | A | 2/2005 |
| WO | 2014047639 | A2 | 3/2014 |

OTHER PUBLICATIONS

China Office Action for corresponding patent application No. 201680054680.2, dated Mar. 25, 2020, 5 pages.

* cited by examiner

FLOATING VESSEL

The invention relates to a floating vessel with a hull, at least one seat and two outriggers arranged laterally to the hull and connected directly or indirectly to the hull, wherein a drive unit, separately controllable in its drive output, and in each case comprising at least one propeller driven by a motor, especially an electric motor, is assigned to each outrigger.

From document US 2004/0168623 A1 (Multi-Hull Personal Watercraft) there is known a watercraft for recreational use with two (catamaran) or more (trimaran) hulls and one or more seats. For the propulsion, one or more water outlets of jet propulsion units are provided. These may be arranged between the hulls or in or on the hulls. The hulls may be dimensioned such that all components or some of the components of a jet propulsion unit can be accommodated therein. For the steering of the watercraft, it is provided that the water ejected from the water outlets is steered independently or dependently through corresponding control means. In this way, for example, the turn radius of the watercraft can be reduced and a better steering control can be achieved. Two motors can be provided, each one associated with a pump. The steering may also be done with a motor, which drives two pumps, while between the motor and the pumps there are provided actuatable means, independent of each other, for influencing the energy transmission from the motor to the pumps. It is also possible to coordinate a motor and a pump with several water outlets, with separate regulation of the volume flow to the water outlets. It is likewise proposed to influence the flow direction of the outgoing water jet or alter the orientation of the jet propulsion unit.

In EP 2 585 363 B1 there is described a watercraft for recreational use with a middle hull and two hulls at the side, set back from the middle hull and mounted removably. The side hulls are designed as closed floats. In one embodiment of the invention, they each contain a motor (jet ski engine). The side hulls are joined together by a frame. The middle hull is joined to the frame and thus the side hulls such that it is pivotable about an axis of rotation running at a slant to the water surface. Its design is open at the top and it carries a seat for a passenger. Handles are mounted on the frame. A passenger, by shifting his weight and exerting pressure on the handles, can pivot the middle hull relative to the frame and thus the side hulls about the axis of rotation and thereby steer the watercraft. In addition, it may be provided to influence the direction of travel by suitable actuation of the motors.

The side hulls may be mounted in different positions transversely and longitudinally to the direction of travel and thereby influence the floating properties of the watercraft.

DE 195 38 563 A1 shows a three-keel drive boat with a foreship and two side ships joined to it. Each time an electric motor is provided in the side ships with a drive rotor arranged between a water inlet opening and a water outlet opening and driven by the electric motor. These propel the watercraft. The watercraft can be steered by the two propulsion units. For this purpose, the motors are each connected by a wire cable to a steering lever. The speed of the motors can be set differently in this way and the direction of travel of the watercraft can be changed.

The drawback to the known watercraft is the mechanical setting of the motor power. For this purpose, for example, Bowden cables or other mechanical servomechanisms must be laid from a helm on the hull of the watercraft to the motors in the outriggers, making the assembly and disassembly of the outrigger more difficult. Such an assembly and disassembly, furthermore, easily results in a shifting of the mechanical servomechanisms, while even a slight misalignment results in different settings of the motor powers and the watercraft might no longer be steered accurately.

The problem which the invention proposes to solve is to create a floating vessel with a hull and two laterally arranged outriggers, which can be easily assembled and disassembled for transport without the riding qualities being adversely affected by the assembly or disassembly.

The problem of the invention is solved in that a helm of the floating vessel is connected to a proportional transducer and in that a control signal from the proportional transducer is supplied to a control unit, which directly or indirectly controls the motors in dependence on the control signal of the proportional transducer. Thus, for the actuation of the motors, electrical connections are required between the helm and the outriggers, which can easily be disconnected and connected once more. A misalignment due to the assembly and disassembly can be ruled out, so that the steering qualities are not negatively influenced. Owing to the proportional transducer, the position of the helm can be very accurately detected and converted into control signals for the motors, so that a precise steering of the floating vessel is made possible. Since no further mechanical servomechanisms need to be moved for the steering, the steering is very smooth. Furthermore, the implementation of the steering with a proportional transducer as compared to mechanical solutions is economical. The setting of the motor powers can be done directly through the control unit or the control unit can actuate other downstream subassemblies, which then actuate the motors.

The power setting can advantageously be done at the motors, when using internal combustion engines, for example by electromechanical actuators.

In order to avoid having to lay cables of the power circuit between the outriggers and the hull when using electric motors, it may be provided that each time a motor controller with a power regulator is arranged in the outriggers and connected to the control unit and that the motor controllers control the motor power of the respectively associated motor in dependence on the control signal of the proportional transducer. Advantageously, then, storage batteries for the power supply of the motors are also arranged in the outriggers. Thus, it is only necessary to lay lines of a control circuit between the hull and the outriggers. As the power regulator it is possible to use, for example, appropriately designed power transistors, which are actuated in dependence on the control signal and adjust the current flow between a power supply and a motor.

Faults in the signal transmission between the helm and the power regulators of the motors can be prevented in that the control unit converts an analog control signal of the proportional transducer into at least one digital control signal or in that the proportional transducer puts out a digital control signal and in that the digital control signal is sent by data connections to the motor controllers arranged in or on the outriggers, which control the power of the respectively associated motor in dependence on the digital control signal. Digital control signals as compared to analog control signals have less fault sensitivity and better capabilities of monitoring the plausibility of the signals. In this way, faults in the actuating of the motors can be avoided, thus enhancing the operational security of the floating vessel.

According to one preferred variant embodiment of the invention it may be provided that the control unit is furnished with a speed signal of a speed regulator of the floating vessel and that the speed signal is taken into account when actuating the motors in dependence on the control signal of the proportional transducer. Thus, it may be provided that an activation of the helm results in no actuation of a motor when the speed regulator is set at zero. It is thus possible to avoid an unintentional actuating of a motor, for example, when climbing aboard the floating vessel. At a middle setting of the speed regulator it may be provided that the power of one motor is increased and the power of the other motor decreased for the steering of the floating vessel, thereby making possible a curved travel. Alternatively, it may be provided that only the power of one motor is increased or that of the opposite motor is decreased in order to travel on a curve. It is also possible to increase the power of the motor on the outside of the curve and at the same time reduce the power of the motor on the inside of the curve. At the maximum speed setting, the power of one motor can be reduced for the steering, while the other motor continues to be operated at maximum power.

In order to obtain an actuation signal for the motors each time that contains both the speed information and the steering information, it may be provided that the control unit forms from the control signal of the proportional transducer and the speed signal of the speed regulator at least one digital actuation signal and supplies it to the motor controllers and/or that the control unit forms from the speed signal of the speed regulator a digital speed signal and supplies it to the motor controllers. The speed signal of the speed regulator and the control signal of the proportional transducer may thus be transformed by the control unit into at least one combined digital signal for the two motor controllers, which thereupon actuate the motors. Alternatively, the speed signal and the control signal may be separately digitized by the control unit and supplied to the motor controllers, which then generate each time an analog actuation signal from the digital control signal and the digital speed signal for the respective coordinated motor.

A simple and precise steering of the floating vessel can be accomplished in that the proportional transducer is designed as an incremental encoder or as a potentiometer or as a capacitive proportional transducer.

Advantageously, it may be provided that the data connection between the control unit and the motor controllers occurs by data lines or by radio links. When using radio links, advantageously one need not arrange any cables between the hull and the outriggers.

It is provided that the data connection is bidirectional, so that both data can be sent from the control unit to the motor controllers and from the motor controllers to the control unit. Thus, for example, motor data can be detected by the motor controllers and sent to the control unit.

According to one variant embodiment of the invention it may be provided that each motor is coordinated with a battery pack consisting of interconnected storage batteries, that the charge status of the battery pack is detected and sent via the data connection to the control unit and that the control unit is designed to limit the maximum available power of the motors equally for both motors in dependence on the charge status of the furthest discharged battery pack. The transmitting of data on the charge status of the battery packs may then occur, for example, from the motor controllers to the control unit. By the equal limiting of the motor power on both sides it is possible to prevent the motors from being operated with different powers on account of different charge statuses of the associated storage batteries.

In order to achieve a precise synchronization of the power output of the two motors and thereby guarantee a precise straight running of the floating vessel, it may be provided that the temperature of the motors and/or the temperature of the storage batteries and/or the temperature of the control unit is detected and taken into account for the limiting of the maximum available power of the motors. The values can be taken into account in addition to the charge status of the respective battery packs.

An easy transportability of the floating vessel may be achieved in that the outriggers are detachably connected to the hull and/or in that the data lines between the control unit and the motor controllers are detachable, in particular of the plug-in kind. Thus the outriggers may be easily separated from the hull and the subassemblies transported individually. The data lines can be separated at the advantageously water-tight plug-in connections. This enables a distinctly easier disassembly of the outriggers than is possible with mechanical control means, such as Bowden cables, etc. When using radio links between the control unit and the motor controllers, no cable connections need to be separated between the hull and the outriggers, which may further simplify the disassembly, as well as the later assembly of the floating vessel.

A particularly space-saving construction of the hull for transport may be achieved in that a steering column, supported by the helm, is hinged to the hull. The steering column may thus be folded up against the hull for transport, which may significantly reduce the outside dimensions of the hull. Since no mechanical control means are needed between the helm and the outriggers, the hinge mechanism of the steering column may have a very simple design. When using data lines between the control unit and the motor controller, these may be led through the hinge connection between the steering column and the hull. Alternatively, the data lines may be led to contacts in the area of the hinge connection, which are made when the steering column is hinged down and broken when the steering column is hinged up. Advantageously, the motors cannot be actuated when the steering column is hinged up.

The riding qualities and the steerability of the floating vessel may be improved in that one or more electric motor-driven control elements are arranged on each of the outriggers and in that these electric motor-driven control elements are actuatable in dependence on the control signal and/or the speed signal and/or the at least one digital actuation signal formed from the control signal and the speed signal. Thus, the electric motor-driven control elements are adjusted in addition to the motors in dependence on the position of the helm or the speed regulator.

It may be provided that control flaps and/or rudders pivotably attached to the outriggers and/or pivotably arranged deflection nozzles and/or pivotably arranged azimuth thrusters are actuatable as electric motor-driven control elements. All these control elements may provide a control action operating in addition to the actuating of the motors.

In order to enable a reverse movement of the floating vessel, it may be provided that the thrust direction of the drive units is reversible. For this purpose, preferably the direction of turning of the motors is reversed as compared to forward travel, so that the propellers turn in the opposite direction. The steering of the floating vessel is done in accordance with the steering in forward travel, by differential actuating of the two motors. Furthermore, a very narrow curve movement can be achieved by reversing the thrust direction of only one drive unit, while the other drive unit continues to operate in the forward direction.

Figure 2:
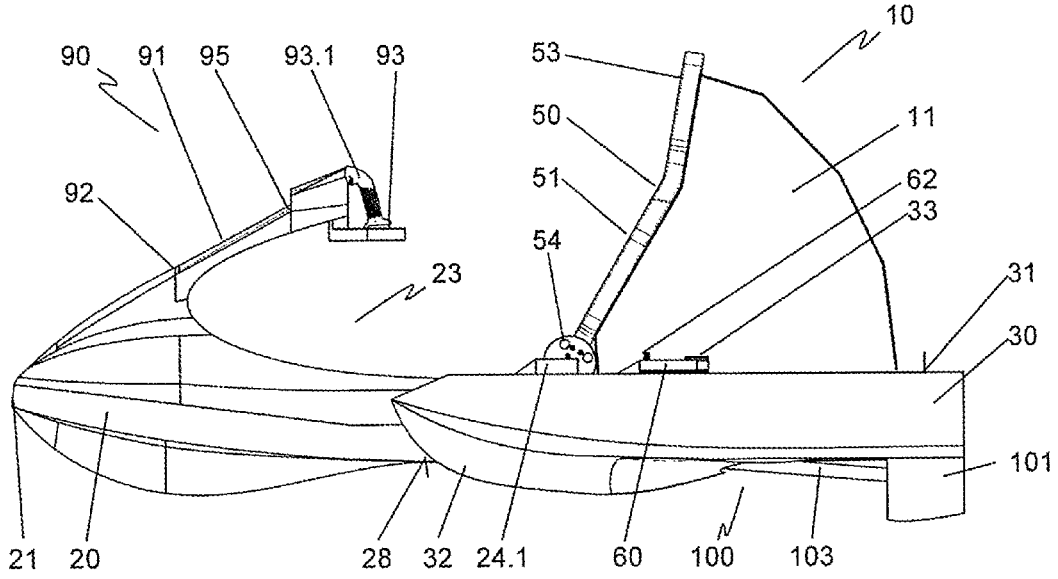
Figure 3:
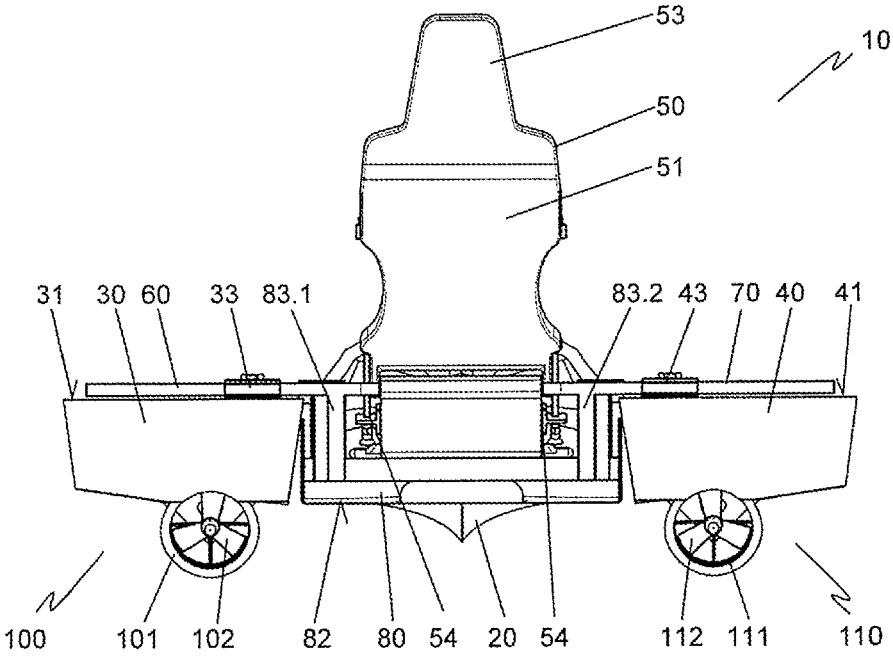
Figure 4:
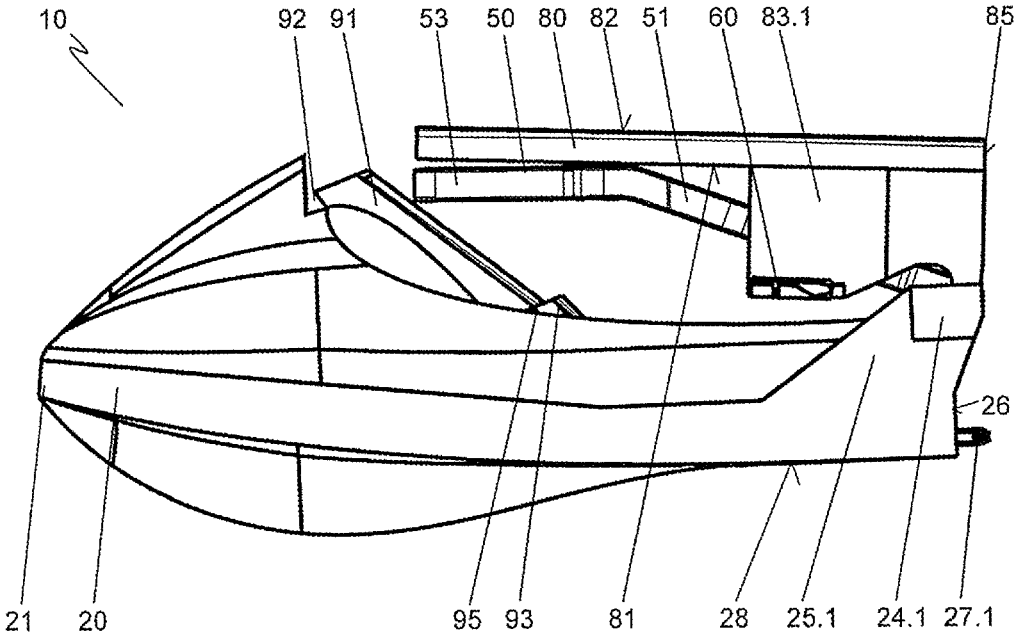
Figure 5:
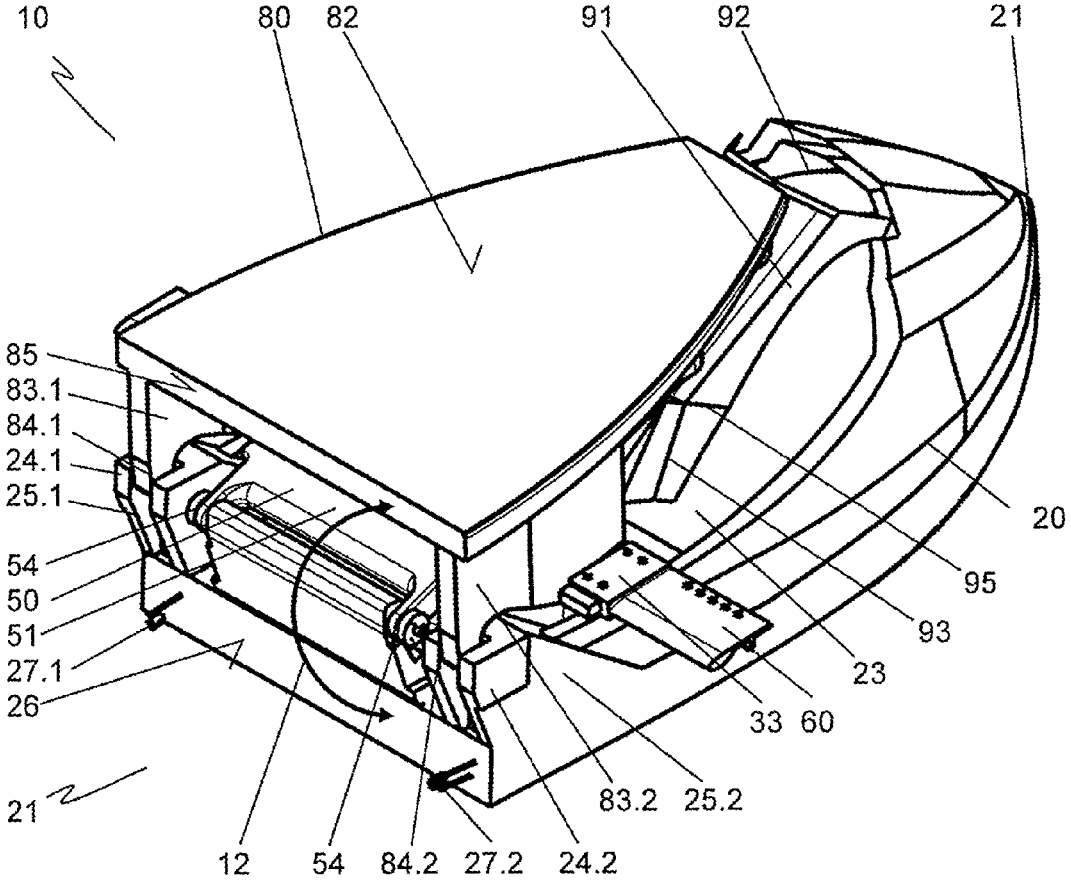
Figure 6:
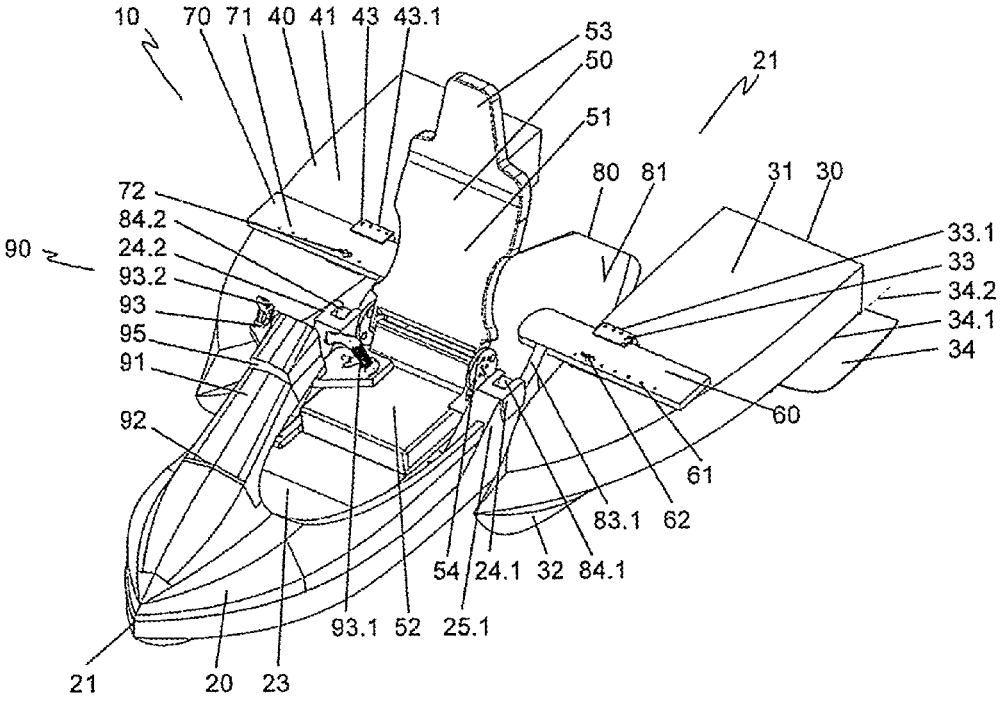
Figure 7:
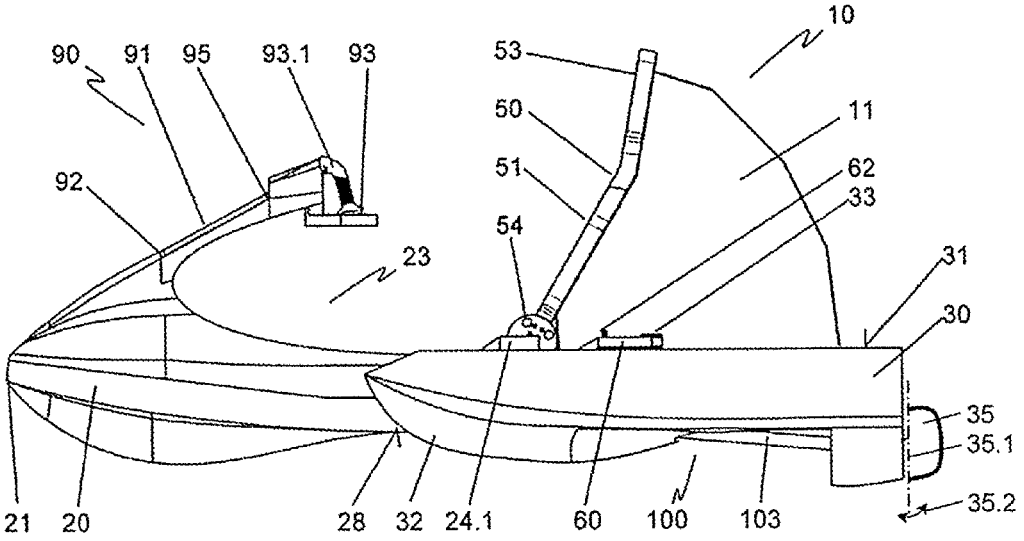
Figure 8:
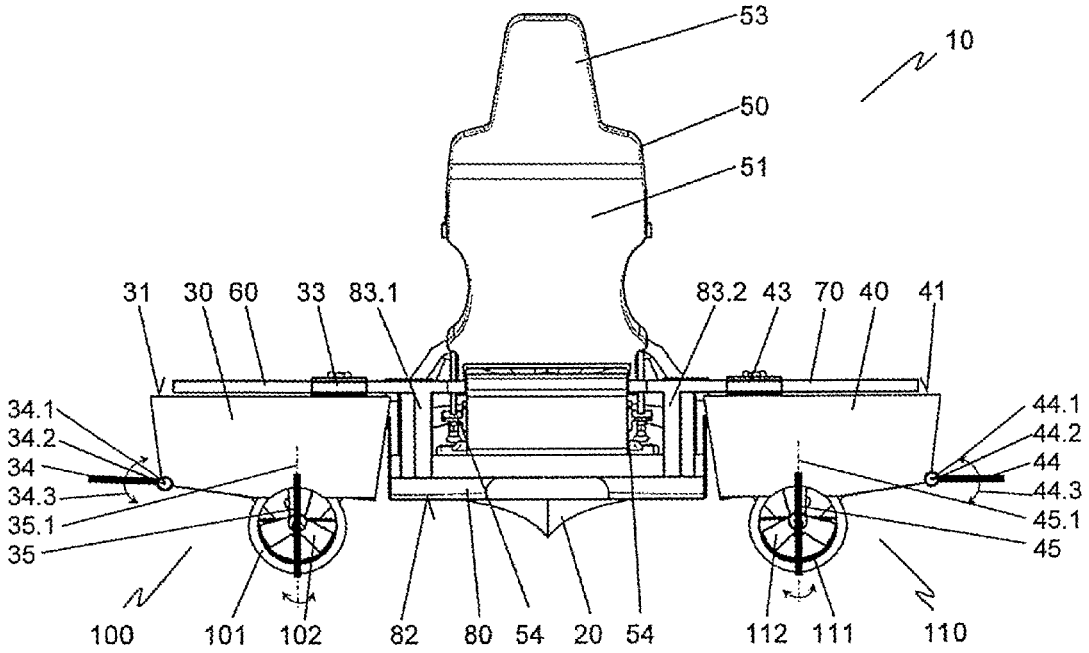
Figure 9:
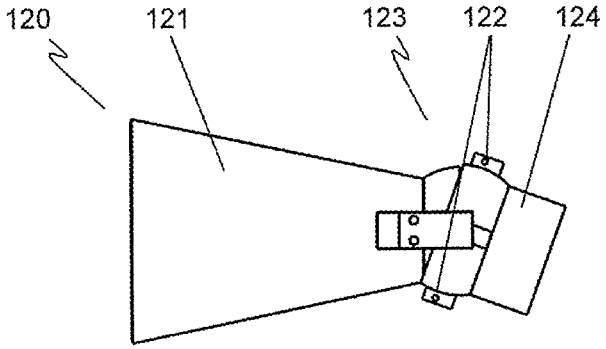
Figure 10:
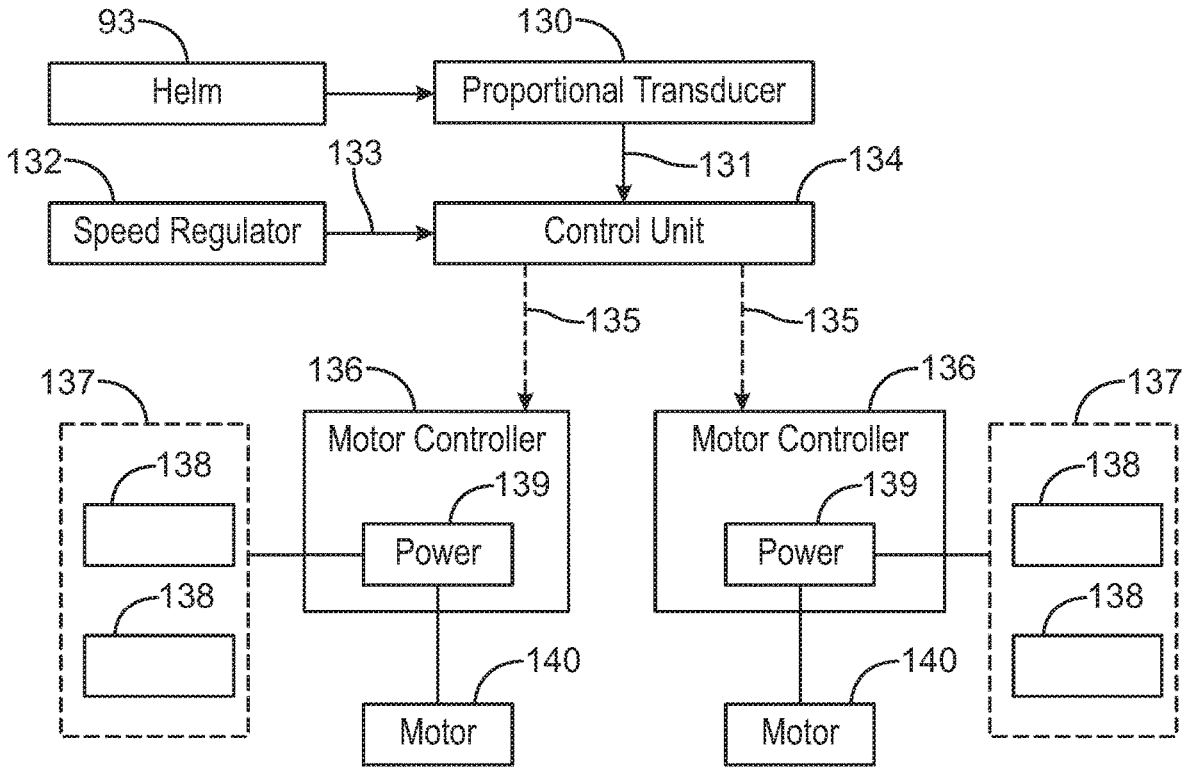

The invention shall be explained more closely below with the aid of a sample embodiment represented in the drawings. There are shown:

FIG. 1 a floating vessel in perspective side view,

FIG. 2 the floating vessel shown in FIG. 1 in a side view,

FIG. 3 the floating vessel shown in FIG. 1 and FIG. 2 in a rear view, FIG. 4 a hull of the floating vessel shown in FIGS. 1, 2 and 3 in a transport position and in a side view, FIG. 5 the floating vessel shown in FIG. 4 in a perspective side view, FIG. 6 the floating vessel of FIG. 1 with additionally mounted control flaps, FIG. 7 the floating vessel of FIG. 2 with additionally mounted rudders, FIG. 8 the floating vessel of FIG. 3 with additionally mounted control flaps and rudders, FIG. 9 a nozzle arrangement for a floating vessel, and FIG. 10 a block diagram representing a control system of the floating vessel of FIG. 1.

FIG. 1 shows a floating vessel 10 in perspective side view. The floating vessel 10 is constructed from a hull 20 and two outriggers 20, 30 arranged laterally thereto and set back in the direction of the rear 21 of the floating vessel 10. The hull 20 carries a seat 50 with a sitting surface 52, a backrest 51 and a headrest 53. The backrest 51 is hinged by an articulated connection 54 to the sitting surface 52. In front of the sitting surface 52, the hull 20 forms a foot area 23. A control system 90 is associated with a steering column 91 and a helm 93. The steering column 91 is oriented from a prow 21 of the floating vessel 10 slanting upward toward the seat 50. At its end facing the prow 21, the steering column 91 is joined by a hinge connection 92 to the hull 20. Opposite this, the helm 93 is joined by a hinge 95 to the steering column 91. The helm 93 in the design variant shown has two control handles 93.1, 93.2, on which the operating elements 94 shown in FIG. 6 are arranged. Furthermore, a display facing the seat 50 and not represented is arranged at the helm 93. In an alternative variant embodiment, the helm may also be designed as a control wheel or steering wheel.

Adjacent to the hull 20 a slide plate 80 is provided between the outriggers 30, 40. In the folded-out operating position shown, a top side 81 of the slide plate 80 faces away from the water surface, while a slide surface 82 of the slide plate 80 shown in FIG. 3 points toward the water surface. Webs 83.1, 83.2 are arranged on the slide plate 80 at the side. The webs 83.1, 83.2 are secured by hinge connections 84.1, 84.2 in an articulated manner to bearing blocks 24.1, 24.2, which are arranged on bearing webs 25.1, 25.2 arranged on the hull 20 at the side. Holders 60, 70 for securing the outriggers 30, 40 are arranged on the webs 83.1, 83.2 of the slide plate 80. Holding devices 33, 43 are arranged on the top sides 31, 41 of the outriggers 30, 40. The holding devices 33, 43 form U-shaped holding sections 33.1, 43.1 in which the holders 60, 70 are inserted. Opposite the holding sections 33.1, 43.1, the holders 60, 70 have fastening seats 61, 71 in the form of boreholes. The holders 60, 70 are connected by fastening elements 62, 72, which are led through the fastening seats 61, 71, to the holding devices 33, 43. Opposite the top sides 31, 41, the outriggers 30, 40 form bottom sides and 32, 42 facing the water.

FIG. 2 shows the floating vessel 10 shown in FIG. 1 in a side view. Between the backrest 51 of the seat 50 and the top side 81 of the slide plate 80 shown in FIG. 1 is arranged an inflatable cushion 11. Uninflated, the cushion 11 can be stowed in the backrest 51 of the seat 50. Alternatively or additionally, an air mattress (not shown) may be integrated in the backrest 51 or in the slide plate 80. The air mattress can be inflated when needed and be pulled by the floating vessel 10. For this purpose, the air mattress is preferably attached to the floating vessel 10. The air mattress affords room for a second passenger and may also be used as rescue gear in an emergency situation.

The slide plate 80 is arranged in its operating position such that its lower slide surface 82 shown in FIG. 3 directly adjoins an underside 28 of the hull 20. The hull underside 28 and the slide surface 82 thus form a continuous surface passing seamlessly into each other and facing the water. Drive units 100, 110 are arranged in the outriggers 30, 40. The drive units 100, 110 comprise motors 140 arranged in the outriggers 30, 40. The motors are preferably designed as electric motors. The power supply in the case of electric motors comes from storage batteries 138, which are hooked up as battery packs 137 and likewise arranged in the outriggers 30, 40. The motors drive propellers 102, 112 via drive shafts 103, shown in FIG. 3. The propellers 102, 112 are arranged inside flow channels 101, 111.

FIG. 3 shows the floating vessel shown in FIG. 1 and FIG. 2 in a rear view.

In FIGS. 1 to 3, the floating vessel 10 is shown in its folded-out operating position. The outriggers 30, 40 are connected by the holders 60, 70 to the hull 20. The seat 50 is folded out and affords room for a passenger. The steering column 91 stands in its operating position, so that the helm 93 and the operating elements 94 can be operated by the passenger. The propulsion of the floating vessel 10 comes from the described drive units 100, 110. For this, the propellers 102, 112 are driven by the motors. The steering of the floating vessel 10 is done via the helm 93 and the operating elements 94 arranged on it. For this, the passenger may grasp the control handles 93.1, 93.2 and turn the helm 93 at the hinge 95 relative to the steering column 91. In the area of the hinge 95 is arranged an electronic proportional transducer 130, as represented in FIG. 10. This is moved by turning the helm 93, which alters a control signal 131 as the output signal of the proportional transducer 130. The control signal is relayed to a control unit 134. The control unit 134 is arranged inside the helm 93 or the steering column 91. A speed regulator 132 is provided on the helm 93 or alternatively in the foot space 23 of the hull 20 for adjusting the speed of the floating vessel 10. A speed signal 133 as the output signal of the speed regulator 132 is likewise supplied to the control unit 134. The control unit 134 forms from the control signal and the speed signal a digital actuation signal for actuating the motors 140. Alternatively, the proportional transducer 130 may already be designed to provide a digital control signal. The digital actuation signal is relayed by data connections to two motor controllers 136, which are arranged in the outriggers 30, 40. The data transmission occurs by data lines 135, or by radio links 135 between the control unit 134 and the motor controller 136. The motor controllers 136 have electronic power regulators 139. These are hooked up between the battery packs 137 and the electric motors 140. With the aid of the power regulators 139, the power of the motors 140 is adjusted in dependence on the actuation signal. A speed adjustment by the speed regulator 132 results in an equal adjustment at the motors, so that the floating vessel 10 runs straight. Preferably, the motors 140 are variable-speed type, so that a good straight running of the floating vessel 10 is achieved. A control signal of the helm 93 results in one of the motors being operated with higher power and thus speed than the other motor. Thus, for example, when it is desired to turn to the right and the helm 93 is turned to the right, the left motor and thus the left propeller 102 is driven more strongly than the right motor with the right propeller 112. This brings about a change in direction of the floating vessel 10. How high the power of the motors will be after a control movement is preferably dictated by the speed setting of the speed regulator 132. Thus, it may be provided that, for a speed setting of zero, a control signal by the helm 93 results in no actuation of the motors or only an actuation with little power. In this way, it can be prevented that the floating vessel 10 is set in motion or set in strong motion by an unintentional steering movement, for example when the passenger is sitting down. In a medium speed setting of the floating vessel 10, the power or speed of one motor can be reduced and that of the opposite motor increased as a result of a steering movement. It is likewise possible to maintain the power of one motor unchanged and only increase or decrease the power of the opposite motor. At the maximum speed setting, on the other hand, it is provided that the power and thus the speed of one motor is reduced, while the opposite motor continues to be operated at maximum power or speed. It is likewise possible to reverse the direction of thrust of one drive unit 100, 110, while the opposite drive unit 100, 110 continues to operate in the forward direction. This actuating of the drive units 100, 110 makes it possible to move through a narrow curve.

The proportional transducer 130 may be designed as an incremental encoder, as a potentiometer or as a capacitive proportional transducer. It provides an analog output signal 131, which is proportional to the position angle of the helm 93. Such proportional transducers are cheap and robust. At the same time, they have a high precision in the relation of their output signal to the position angle of the helm 93, so that a precise steering of the floating vessel 10 is made possible. According to one alternative variant embodiment of the invention, it may also be provided that the proportional transducer puts out a digital signal directly in dependence on its set position.

When there is a data connection between the control unit and the motor controllers via data lines 135, these are connected detachably, preferably in the manner of a plug, to the hull 20 and the outriggers 30, 40. For the disassembly of the outriggers 30, 40, the data lines may thus be easily separated. The plug connections are accordingly designed water-tight. In one possible embodiment of the invention, the data lines are laid in the holders 60, 70. In event of a radio link 135 between the control unit and the motor controllers, advantageously no data or signal lines are needed between the hull 20 and the outriggers 30, 40, which further simplifies the assembly and disassembly of the outriggers 30, 40.

In the sample embodiment shown, the actuation signal for the actuating of the motors is formed by the control unit 134 from the analog control signal 131 of the helm 93 and the speed signal 133 of the speed regulator 132 and relayed to the motor controllers 136. Alternatively, it is also possible to relay the control signal and the speed signal separately to the motor controllers 136. These form therefrom the respective actuation signal for the power setting of the motors 140. It is likewise possible to arrange the power regulators 139 in the hull 20, for example integrated at the control unit 134. But the drawback here is that cables of the power circuit need to be laid between the outriggers 30, 40 and the hull 20.

In the sample embodiment shown, electric motors 140 are furthermore provided for the propulsion of the floating vessel 10. The power setting of the electric motors is then done advantageously by power regulators 139 provided at the motor controllers 136, especially by suitable power transistors. These are hooked up between storage batteries 138, interconnected as battery packs 137, and the electric motors 140, with one battery pack being arranged in each outrigger 30, 40. Advantageously, the data connection 135 between the control unit and the motor controllers is bidirectional. Furthermore, the motor controllers 136 are advantageously designed to detect the charge status of the battery packs 137 and transmit this to the control unit 134. The control unit can then take the charge status of the battery packs into account when setting the motor powers. In the sample embodiment shown, it is provided that the motor power or speed of the motors is limited in dependence on the charge status of the furthest discharged battery pack. This prevents one motor from being operated with a lower maximum power or speed than the other motor on account of different charge statuses of the battery packs. Advantageously, in addition to the charge status of the battery packs, the temperature of the motors, the temperature of the storage batteries and/or the temperature of the control unit is detected and taken into account for the limiting of the motor power or speed.

Alternatively to the electric motors, internal combustion engines may also be used, being arranged in the outriggers 30, 40. Advantageously, in this case, electric motor-driven actuators are arranged in the outriggers 30, 40, which set the power or speed of the motors in dependence on the actuation signal put out by the control unit 134.

The outriggers 30, 40 are connected by the holders 60, 70 to the slide plate 80. Alternatively, however, the holders 60, 70 may also be secured to the hull 20. The holding devices 33, 43 and the fastening elements 62, 72 are designed such that the outriggers 30, 40 can be quickly and easily loosened from the holders 60, 70 and attached to them. This makes possible a quick and easy assembly and disassembly of the outriggers 30, 40. Furthermore, the holders 60, 70 comprise several fastening seats 61, 71. These make it possible to arrange and secure the outriggers 30, 40 in different positions relative to the hull 20. In this way, the riding qualities of the floating vessel 10 may be adapted to the respective circumstances or the wishes of the driver.

The slide plate 80 is hinged to the rear 21 of the hull 20 and lies, in the operating position shown, with its slide surface 82 on the water surface. The slide plate 80 improves the sliding properties of the floating vessel 10 so that the floating vessel 10 switches from displacement movement to sliding movement already at relative low speeds. The inflatable cushion 11 provides for additional buoyancy, especially during slow travel or at standstill of the floating vessel 10. Furthermore, the inflatable cushion 11 brings about a mutual bracing of the backrest 51 of the seat 50 and the slide plate 80, which results in additional stabilization of the positions of the backrest 51 and the slide plate 80, especially at high speeds of the floating vessel 10. The slide plate 80, the backrest 51 and the steering column 91 are locked in the operating position.

FIG. 4 shows a hull of the floating vessel 10 shown in FIGS. 1, 2 and 3 in a transport position and in a side view and FIG. 5 shows the floating vessel shown in FIG. 4 in a perspective side view.

The outriggers 30, 40 shown in FIGS. 1 to 3 have been dismounted from the holders 60, 70. The steering column 91 is folded up at the hinge connection 92 toward the foot space 23 of the hull 20. The helm 93 is thus situated in front of the sitting surface 52 in the foot space 23 of the hull 20. The backrest 51 of the seat 50 is folded up at the hinge connection 54 toward the steering column 91 according to a double arrow 12 shown in FIG. 5. It rests with its headrest 53 against the steering column 91. The slide plate 80 is likewise folded up into its transport position relative to the prow 21 of the hull 20 according to the double arrow 12. For this purpose, the slide plate 80 is pivoted about the hinge connections 84.1, 84.2, as shown in FIG. 1. The hinge connections 84.1, 84.2 are situated at the top end of the webs 83.1, 83.2 and on the bearing blocks 24.1, 24.2, which are arranged at the upper end of the bearing webs 25.1, 25.2. Owing to this spacing of the slide plate 80 from the hinge connections 84.1, 84.2, the slide plate 80 can be pivoted so that it rests, in the transport position shown, with its top side 81 against the backrest 51 or the headrest 53 of the folded-up seat 50. The slide surface 82 is turned outward and covers the seat 50, the steering column 91 with the helm 93 and the foot space 23. In this way, they are protected during transport. The holders 60, 70 are folded forward with the slide plate 80. Advantageously, the slide plate 80 and the backrest 52 as well as the steering column 91 are locked in their transport positions.

In its operating position, as shown in FIGS. 1 to 3, the slide plate 80 rests with a stop surface 85 against an abutment surface 26 at the rear 22 of the hull 20 and is held here by retaining brackets 27.1, 27.2.

In another embodiment of the invention, not shown, the holders 60, 70 may be further designed to be foldable or retractable, so that the outer dimensions of the hull 20 can be further reduced in its transport position.

Owing to the easily removable outriggers 30, 40 and the easily separated data connections between the control unit and the motor controllers, the floating vessel 10 may thus be easily broken down for transport into its individual parts, namely, the hull 20 and the two outriggers 30, 40. Owing to the folding steering column 91, the folding seat 50 and the folding slide plate 80, the outer dimensions of the hull 20 can be significantly reduced for transport. Thus, the floating vessel 10 is present as subassemblies which can be carried by a single person, namely, the left and the right outriggers 30, 40, as well as the hull 20 in its reduced outer dimensions.

The assembly of the floating vessel 10 can be easily done, for example, on the water. For this, the slide plate 80, the backrest 51 and the steering column 91 are folded into their operating position and locked there. Next, the outriggers 30, 40 are connected to the holders 60, 70. The desired positions of the outriggers 30, 40 with respect to the hull 20 are adjusted in the process. After this, the data lines 135 for transmission of the actuation signals are plugged into the corresponding sockets.

FIG. 6 shows the floating vessel 10 of FIG. 1 with additionally mounted control flaps 34, 44. The control flaps 34, 44 are attached by means of joints 34.1, 44.1 to the left and right outrigger 30, 40. The control flaps 34, 35 constitute electromechanically movable control elements, which can be adjusted in their orientation to the outriggers 30, 40. For this, electromechanically operated actuators are provided, not being shown. These are actuated in dependence on the control signal of the helm 93. With the aid of the control flaps 34, 35, the maneuverability of the watercraft 10 can be further improved.

FIG. 7 shows the floating vessel 10 of FIG. 2 with additionally mounted rudders 35, 45. FIG. 8 shows the floating vessel 10 of FIG. 3 with additionally mounted control flaps 34, 44 and rudders 35, 45.

As can be seen especially from FIG. 8, the rudders 35, 45 are arranged in a prolongation of the flow channels 101, 111. Thus, they lie directly in the flow region of the water ejected by the propellers 102, 112. The rudders 35, 45 can be pivoted about corresponding rudder axes 35.1, 45.1 by electromechanically operated control elements, not shown, upon activating the helm 93 according to the double arrow 35.2, 45.2 shown. At the same time, the control flaps 34, 44 can be rotated about their axes of rotation 34.2, 44.2 formed by the joints 34.1, 44.1. Owing to the rudders 35, 45 and the control flaps 34, 44, the steerability of the floating vessel 10 can be improved as compared to a steering by the drive units 100, 110 alone.

FIG. 8 shows a nozzle arrangement 120 for a floating vessel 10. The nozzle arrangement 120 is formed by a thrust nozzle 121 and a reversing nozzle 124 connected to the latter by a hinged connection 123. At the side, application points 122 are arranged on the reversing nozzle 124 in the region of the hinged connection 123.

The nozzle arrangement 120 is part of a jet drive unit, which may be provided alternatively to the drive units 100, 110 shown. A jet drive unit is arranged each time in an outrigger 30, 40. In such a jet drive unit, a propeller in the form of an impeller driven by a motor is arranged in a flow channel. The impeller sucks in water from a water inlet opening and ejects it by the nozzle arrangement 120 shown toward the rear 22 of the floating vessel 10. The floating vessel 10 is propelled by the recoil produced in this way. To improve the steer ability of the floating vessel 10, the orientation of the deflecting nozzle 124 and thus the direction of ejection of the water jet may be changed. This is done in dependence on the control signal of the proportional transducer 130 by electromechanically operated control elements, not shown, which are connected to the application points 122.

The invention claimed is:

1. A floating vessel comprising:

a hull;

at least one seat and two outriggers arranged laterally to the hull and coupled to the hull;

a drive unit assigned to each of the at least two outriggers, each drive unit separately controllable in its respective drive output and comprising at least one propeller driven by a motor;

a proportional transducer coupled to a helm of the floating vessel, and configured to supply a control signal to a control unit;

a motor controller with a power regulator arranged in each of the at least two outriggers and coupled to the control unit;

wherein the control unit is configured to convert an analog control signal of the proportional transducer into at least one digital control signal, and the digital control signal is sent by data connections to the motor controllers arranged in or on the at least two outriggers, which control the power of the respectively associated motor in dependence on the digital control signal, and wherein the data connection between the control unit and the motor controllers occurs by data lines or by radio links, and wherein a steering column, supported by the helm, is hinged to the hull.

2. The floating vessel of claim 1, wherein the control unit is furnished with a speed signal of a speed regulator of the floating vessel, and wherein the control unit is configured to control the motors further based on the speed signal.

3. The floating vessel of claim 2, wherein the control unit forms at least one digital actuation signal from the control signal of the proportional transducer and the speed signal of the speed regulator and supplies it to the motor controllers.

4. The floating vessel of claim 2, wherein the control unit forms a digital speed signal from the speed signal of the speed regulator and supplies it to the motor controllers.

5. The floating vessel of claim 1, wherein the proportional transducer is designed as an incremental encoder or as a potentiometer or as a capacitive proportional transducer.

6. The floating vessel of claim 1, wherein the data connection is bidirectional.

7. The floating vessel of claim 1, wherein:

each motor is coordinated with a battery pack consisting of interconnected storage batteries, a charge status of the battery pack is detected and sent via a data connection to the control unit, and the control unit is configured to limit the maximum available power of the motors equally for both motors in dependence on the charge status of the furthest discharged battery pack.

8. The floating vessel of claim 7, wherein any one or more of a temperature of the motors, a temperature of the storage batteries, and a temperature of the control unit is detected and taken into account for the limiting of the maximum available power of the motors.

9. The floating vessel of claim 1, wherein the at least two outriggers are detachably connected to the hull.

10. The floating vessel of claim 1, wherein the data lines between the control unit and the motor controllers are detachable.

11. The floating vessel of claim 2, wherein one or more electric motor-driven control elements are arranged on each of the at least two outriggers and in that these electric motor-driven control elements are actuatable in dependence on any one or more of the control signal, the speed signal, and at least one digital actuation signal formed from the analog control signal and the speed signal.

12. The floating vessel of claim 11, wherein any one or more of control flaps, rudders pivotably attached to the at least two outriggers, pivotably arranged deflection nozzles, and pivotably arranged azimuth thrusters are actuatable as electric motor-driven control elements.

13. The floating vessel of claim 1, wherein a thrust direction of the drive units is reversible.

14. A floating vessel comprising:

a hull;

at least two outriggers arranged laterally to the hull and coupled to the hull;

a drive unit assigned to each of the at least two outriggers, each drive unit separately controllable in its respective drive output and comprising at least one propeller driven by a motor;

a proportional transducer coupled to a helm of the floating vessel, and configured to supply a control signal to a control unit;

a steering column supported by the helm and hinged to the hull;

wherein the control unit is configured to control the motors in dependence on the control signal of the proportional transducer.

15. The floating vessel of claim 14, wherein:

the control unit is configured to convert an analog control signal of the proportional transducer into at least one digital control signal, and the at least one digital control signal is sent by data lines to motor controllers arranged in or on the at least two outriggers, which control the power of the respectively associated motor in dependence on the digital control signal, and the data lines are led through a hinge connection between the steering column and the hull.

16. The floating vessel of claim 14, wherein:

the control unit is configured to convert an analog control signal of the proportional transducer into at least one digital control signal, and the at least one digital control signal is sent by data lines to motor controllers arranged in or on the at least two outriggers, which control the power of the respectively associated motor in dependence on the digital control signal, contacts associated with the data lines are connected when the steering column is hinged into a first position, wherein actuation of the motors is enabled, and contacts associated with the data lines are broken when the steering column is hinged into a second position, wherein actuation of the motors is disabled.

17. The floating vessel of claim 14, wherein the proportional transducer puts out a digital control signal that is sent by data connections to motor controllers arranged in or on the at least two outriggers, which control the power of the respectively associated motor in dependence on the digital control signal.

18. A floating vessel comprising:

a hull;

at least two outriggers arranged laterally to the hull and coupled to the hull;

a drive unit assigned to each of the at least two outriggers, each drive unit separately controllable in its respective drive output and comprising at least one propeller driven by a motor;

a proportional transducer coupled to a helm of the floating vessel, and configured to supply a control signal;

a speed regulator configured to supply a speed signal;

wherein any one or more of control flaps, pivotably arranged rudders, pivotably arranged deflection nozzles, and pivotably arranged azimuth thrusters are arranged on each of the at least two outriggers as electric motor-driven control elements; and wherein the one or more electric motor-driven control elements are actuatable in dependence on any one or more of the control signal, the speed signal, and at least one digital actuation signal formed from the analog control signal and the speed signal.

19. The floating vessel of claim 18, wherein the proportional transducer puts out a digital control signal that is sent by data connections to motor controllers arranged in or on the at least two outriggers, which control the power of the respectively associated motor in dependence on the digital control signal.

20. A floating vessel comprising:

a hull;

at least one seat and two outriggers arranged laterally to the hull and coupled to the hull;

a drive unit assigned to each of the at least two outriggers, each drive unit separately controllable in its respective drive output and comprising at least one propeller driven by a motor;

a proportional transducer coupled to a helm of the floating vessel, and configured to supply a control signal to a control unit;

a motor controller with a power regulator arranged in each of the at least two outriggers and coupled to the control unit;

wherein the control unit is configured to convert an analog control signal of the proportional transducer into at least one digital control signal, and the digital control signal is sent by data connections to the motor controllers arranged in or on the at least two outriggers, which control the power of the respectively associated motor in dependence on the digital control signal, wherein the data connection between the control unit and the motor controllers occurs by data lines or by radio links, wherein the control unit is furnished with a speed signal of a speed regulator of the floating vessel, and wherein the control unit is configured to control the motors further based on the speed signal, wherein one or more electric motor-driven control elements are arranged on each of the at least two outriggers and in that these electric motor-driven control elements are actuatable in dependence on any one or more of the control signal, the speed signal, and at least one digital actuation signal formed from the analog control signal and the speed signal, and wherein any one or more of control flaps, rudders pivotably attached to the at least two outriggers, pivotably arranged deflection nozzles, and pivotably arranged azimuth thrusters are actuatable as electric motor-driven control elements.

* * * * *